United States Patent [19]

Alexander et al.

[11] Patent Number: 4,984,778

[45] Date of Patent: Jan. 15, 1991

[54] SHEET FEEDER WITH SKEW CONTROL

[75] Inventors: Thomas R. Alexander; Donato D. Evangelista, both of Webster; Michael F. Leo, Penfield, all of N.Y.

[73] Assignee: Xerox Corporation, Stamford, Conn.

[21] Appl. No.: 327,635

[22] Filed: Mar. 23, 1989

[51] Int. Cl.[5] ..... B65H 3/06

[52] U.S. Cl. ..... 271/117; 271/121; 271/226; 271/264

[58] Field of Search ..... 271/117, 121, 167, 226, 271/250, 251, 264, 275; 226/15, 21

[56] References Cited

U.S. PATENT DOCUMENTS

| | | | |
|---|---|---|---|
| 3,176,980 | 1/1963 | Mitchell et al. | 271/251 |
| 3,430,948 | 3/1969 | Sage | 271/167 |
| 3,601,392 | 8/1971 | Spears, Jr. et al. | 271/53 |
| 3,893,662 | 7/1975 | Boyd | 271/10 |
| 3,970,299 | 7/1976 | Berger, Jr. et al. | 271/250 |
| 3,980,295 | 9/1976 | Kleid | 271/242 |
| 4,130,275 | 12/1978 | Rozga | 271/251 |
| 4,214,689 | 7/1980 | Bartel et al. | 226/21 |
| 4,676,498 | 6/1987 | Kanemitsu et al. | 271/251 |
| 4,795,070 | 1/1989 | Blanding et al. | 226/15 |

FOREIGN PATENT DOCUMENTS

| | | | |
|---|---|---|---|
| 58-26741 | 2/1983 | Japan . | |
| 0148131 | 9/1983 | Japan | 271/117 |
| 0002642 | 1/1986 | Japan | 271/251 |
| 0226431 | 10/1986 | Japan | 271/117 |
| 0051521 | 3/1987 | Japan | 271/117 |

OTHER PUBLICATIONS

IBM Technical Disclosure Bulletin, vol. 20, No. 4, Sep. 1977, Author: R. A. Lamos, Title: Aligning Sheet Feeder.

Xerox Disclosure Journal, vol. 12, No. 1, Jan./Feb. 1987, Author: William D. Milillo, Title: Document Feeder Edge Biasing Device.

Cole, "Controlled Skew Feed Roll Shaft", IBM Technical Disclosure Bulletin, vol. 19, No. 3, 8-1976.

*Primary Examiner*—H. Grant Skaggs
*Assistant Examiner*—Boris Milef

[57] ABSTRACT

An apparatus for feeding sheets has a surface over which a sheet may be fed, a sheet feeder for feeding sheets over the surface having a centerline of feed parallel to the direction of sheet feeding and at least one idler roll to inhibit skewing of a sheet being fed by the sheet feeder which is mounted for rotational contact with a sheet being fed on the centerline of the sheet feeder whereby a torque is not imparted to a sheet being fed in either the clockwise or counter-clockwise direction. The idler roll has a high fractional contact surface and is mounted to provide a low drag force in the feeding direction and a high lateral drag force to inhibit a sheet being fed from skewing.

20 Claims, 6 Drawing Sheets

SHEET FEEDER WITH SKEW CONTROL

CROSS REFERENCE TO RELATED APPLICATION

Attention is directed to copending application Ser. No. 07/327,500, entitled Feeder Reversing Drive, filed concurrently herewith in the names of Donato D. Evangelista, Norman E. LaTour and Bobby Kirven.

BACKGROUND OF THE INVENTION

The present invention relates to a sheet feeder and more particularly to a sheet feeder which has a skew control idler roll.

The present invention is particularly adapted for use with automatic printing apparatus for producing prints of original documents as well as electronically created and digitally stored images which are made available through the use of electrostatographic printing techniques. Various types of sheet feeders have been used to feed copy or print sheets to the printing machine to obtain a toner image thereon or to feed documents which are to be reproduced onto the imaging platen of the reproduction machine. Thus, for example, devices rely on the operator manually aligning one edge of a document against the registration edge with the device subsequently automatically transporting the sheet in a direction parallel to the registration edge. These devices come in several forms including those wherein the registration edge is adjustable to accommodate sheets of different dimensions and also to enable the sheet feed mechanism to contact the top sheet in a stack of sheets in the center of the sheet. Alternatively, a side registration device may be employed wherein the registration edge is fixed relative to a fixed feeding mechanism. In both of these devices difficulties may be encountered with a feeding of sheets in that there may be a tendency for the sheet to skew in a direction lateral to rather than parallel to the sheet feeding direction. Sheet feeders such as friction retard devices with small foot prints demonstrate a particularly high sensitivity to sheet skew. For example, if there is a wall or something close to the edge of the paper as it is being fed that can contact the corner and buckle it a paper jam could result. In those devices where the feeding mechanism may not be in the center of the paper being fed, there is a natural tendency to generate a moment to rotate the paper in a counterclockwise direction (see FIG. 3A). If the corner of the paper will scrub against the registration edge which tends to turn it even more resulting in possible damage to the paper, creation of a buckle in the corner of the paper which eventually leads to a paper jam. In addition, the desire to feed many different sheet sizes with a fixed position feed head wherein the feed head is off center with the centerline of a paper can accentuate the problem causing in addition to sheet skew, centration problems in maintaining the sheet fed along the centerline. Furthermore, in many specific applications, the difficulties may be exaggerated because of the very close tolerance or small clearances permitted in the paper path. In these situations, a very, very small skew may cause the paper to contact a frame or other machine member buckling the corner and eventually resulting in a paper jam.

PRIOR ART

Many attempts in different devices have been previously used to correct skew formed in sheets being fed.

Typically, these have taken the form of devices applying a drag force or a torque couple to the sheet being fed to rotate it against an edge guide. Illustrative devices include:

Japanese Patent No. 58-26741(A)(2) - Iguchi discloses an automatic device for feeding paper of different sizes. The frictional force of a weight roller and a feed roller couple to apply a force in a counterclockwise direction. This force aligns the original along a side registration guide so that even varying width the papers are feed accurately.

IBM Technical Disclosure Bulletin, Vol. 20, No. 4 Sept. 1977, Page 1295 to Lamos discloses an aligning sheet feeder. The action of a roller, side registration edge and drag force combine to turn a sheet and align it with a registration edge. To this end, the roller is positioned between the registration edge in the center of gravity of the sheet.

Xerox Disclosure Journal, Vol. 12, No. 1, Jan./Feb. 1987, Page 53–54 to Milillo describes a feeder edge biasing device which shows the use of high friction pads to a stack load arm and to a document tray directly beneath the arm in order to provide a pivot point in an off center bottom feeder to align fed documents against an edge guide. The stack arm offsets the moment created by the feeder on the rest of the stack and thereby allows the accommodation of feeding mixed sizes of documents from a tray having only a single edge guide.

SUMMARY OF THE INVENTION

In accordance with a principle aspect of the present invention an apparatus for feeding sheets is provided comprising a surface over which a sheet may be fed, means for feeding sheets over the surface having a centerline of feed parallel to the direction of sheet feeding and at least one idler roll to inhibit skewing of a sheet being fed which is mounted for rotational contact with the sheet being fed on the centerline of the feed means whereby a torque is not imparted to a sheet being fed in either the clockwise or counterclockwise direction. The roller has a high frictional contact surface and is mounted to provide a low drag force in the feeding direction and a high lateral drag force to inhibit a sheet being fed from skewing.

In accordance with a further aspect of the present invention, the deskewing idler roll may be upstream, downstream or both upstream and downstream of the feeding means.

In a further aspect of the present invention, a sheet being fed is fed over a planar feed table which has a side edge guide parallel to the feeding direction at one end thereof to guide the sheet being fed.

In a further aspect of the present invention, the side edge guide is positioned a fixed lateral distance from the centerline of feed to provide a side registration of sheets being fed.

In a further aspect of the present invention, the side edge guide is movable relative to the feed table and the feeding means affixed relative to the feed table.

In a further aspect of the present invention, the distance in the feeding direction between the feeding means and the idler roll is less than the dimension in the feeding direction of a sheet to be fed.

In a further aspect of the present invention, the idler roll has a coefficient of friction with the sheet being fed of from about 1.5 to about 1.75 and provides a normal force on the sheet being fed of from about 30 grams to about 70 grams.

In a further aspect of the present invention, the feeding means is a top feeding friction retard feeder having a retard pad in the planar surface, two feed rolls rotatable in the feeding direction and forming a separating feeding nip with the retard pad and being axially spaced on an axis perpendicular to the feeding direction with the centerline of feed midway between the feed rolls.

In a further aspect of the present invention, the friction retard feeder includes two nudger rolls rotatable in the feeding direction and axially spaced on an axis perpendicular to the feeding direction and wherein the centerline of feed is midway between the nudger rolls, the nudger rolls being positioned upstream of the nip between the feed rolls and the retard pad to urge the sheet being fed into the nip.

Other features of the present invention will become apparent as the following description proceeds and upon reference to the drawings.

DESCRIPTION OF THE PREFERRED EMBODIMENT

The invention will now be described with reference to a preferred embodiment of the sheet feeder with skew control in an electrostatographic printing apparatus.

Figure 1:
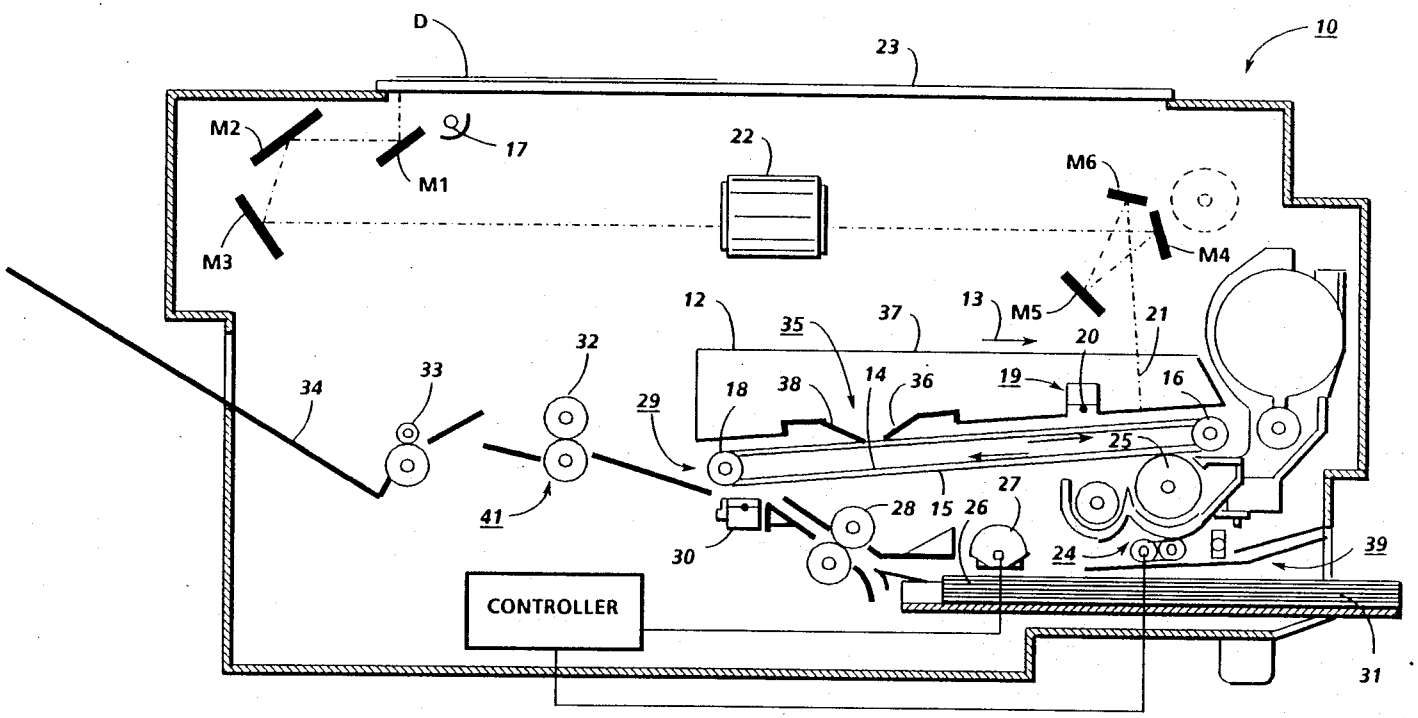
FIG. 1 is a schematic representation in cross section of an automatic electrostatographic printing machine which may employ a sheet feeder according to the present invention.

Referring now to FIG. 1, there is shown by way of example, an automatic electrostatographic reproducing machine 10 which includes the skew control device according to the present invention. The reproducing machine depicted in FIG. 1 illustrates the various components utilized therein for producing copies from an original document. Although the apparatus of the present invention is particularly well adapted for use in automatic electrostatographic reproducing machines, it should become evident from the following description that it is equally well suited for use in a wide variety of processing systems including other electrostatographic systems and is not necessarily limited in application to the particular embodiment or embodiment shown herein.

The reproducing machine 10 illustrated in FIG. 1 employs a removable processing cartridge 12 which may be inserted and withdrawn from the main machine frame in the direction of arrow 13. Cartridge 12 includes an image recording belt like member 14 the outer periphery of which is coated with a suitable photoconductive material 15. The belt is suitably mounted for revolution within the cartridge about driven transport roll 16, around idler roll 18 and travels in the direction indicated by the arrows on the inner run of the belt to bring the image bearing surface thereon past the plurality of xerographic processing stations. Suitable drive means such as a motor, not shown, are provided to power and coordinate the motion of the various cooperating machine components whereby a faithful reproduction of the original input scene information is recorded upon a sheet of final support material 31, such as paper or the like.

Initially, the belt 14 moves the photoconductive surface 15 through a charging station 19 wherein the belt is uniformly charged with an electrostatic charge placed on the photoconductive surface by charge corotron 20 in known manner preparatory to imaging. Thereafter, the belt 14 is driven to exposure station 21 wherein the charged photoconductive surface 15 is exposed to the light image of the original input scene information, whereby the charge is selectively dissipated in the light exposed regions to record the original input scene in the form of electrostatic latent image.

The optical arrangement creating the latent image comprises a scanning optical system with lamp 17 and mirrors $M_1$, $M_2$, $M_3$ mounted to a scanning carriage (not shown) to scan the original document D on the imaging platen 23, lens 22 and mirrors $M_4$, $M_5$, $M_6$ to transmit the image to the photoconductive belt in known manner. The speed of the scanning carriage and the speed of the photoconductive belt are synchronized to provide faithful reproduction of the original document. After exposure of belt 14 the electrostatic latent image recorded on the photoconductive surface 15 is transported to development station 24, wherein developer is applied to the photoconductive surface 15 of the belt 14 rendering the latent image visible. The development station includes a magnetic brush development system including developer roll 25 utilizing a magnetizable developer mix having course magnetic carrier granules and toner colorant particles as will be discussed in greater detail hereinafter.

Sheets 31 of the final support material are supported in a stack arranged on elevated stack support tray 26. With the stack at its elevated position, the sheet separator segmented feed roll 27 feeds individual sheets therefrom to the registration pinch roll pair 28. The sheet is then forwarded to the transfer station 29 in proper registration with the image on the belt and the developed image on the photoconductive surface 15 is brought into contact with the sheet 31 of final support material within the transfer station 29 and the toner image is transferred from the photoconductive surface 15 to the contacting side of the final support sheet 31 by means of transfer corotron 30. Following transfer of the image, the final support material which may be paper, plastic, etc., as desired, is separated from the belt by the beam strength of the support material 31 as it passes around the idler roll 18, and the sheet containing the toner image thereon is advanced to fixing station 41 wherein roll fuser 32 fixes the transferred powder image thereto. After fusing the toner image to the copy sheet the sheet 31 is advanced by output rolls 33 to sheet stacking tray 34.

Although a preponderance of toner powder is transferred to the final support material 31, invariably some residual toner remains on the photoconductive surface 15 after the transfer of the toner powder image to the final support material. The residual toner particles remaining on the photoconductive surface after the transfer operation are removed from the belt 14 by the cleaning station 35 which comprises a cleaning blade 36 in scrapping contact with the outer periphery of the belt 14 and contained within cleaning housing 37 which has a cleaning seal 38 associated with the upstream opening of the cleaning housing. Alternatively, the toner particles may be mechanically cleaned from the photoconductive surface by a cleaning brush as is well known in the art.

It is believed that the foregoing general description is sufficient for the purposes of the present application to illustrate the general operation of an automatic xerographic copier 10 which can embody the apparatus in accordance with the present invention.

Figure 2:
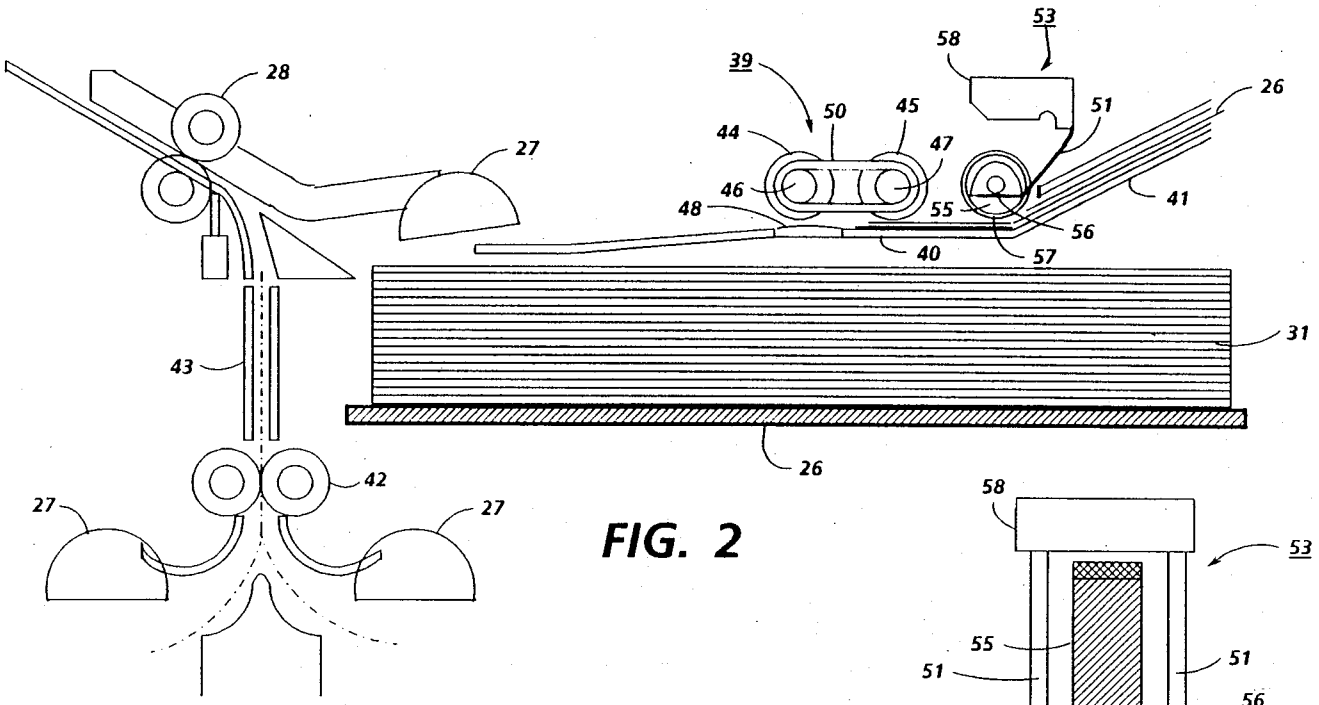
FIG. 2 is an enlarged representation in cross section illustrating the sheet feeder according to the present invention as a bypass feeder in an automatic printing machine.
Figure 6:
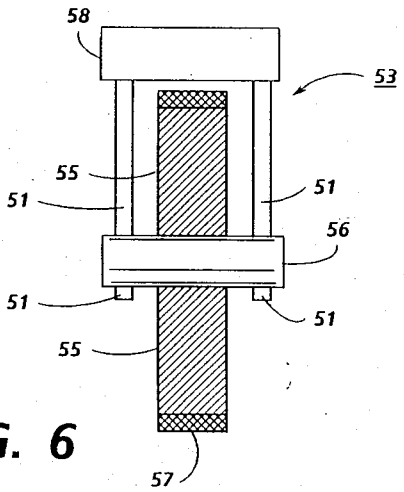
FIG. 6 is a sectional view of the skew control idler roll in its mounting frame.

With continued reference to FIG. 1, and additional reference to FIGS. 2, 3A, 3B, 3C, 5A, 5B, and 6 the sheet feeder with skew control idler roll will be described in greater detail with particular reference to a bypass feeder 39 in the printing machine. As illustrated in FIG. 2, the automatic printing machine has three normal supplies of stacks of sheets associated with each of segmented feed rolls 27. It is noted that sheets from the two lowermost supporting trays (not shown) are transported upwardly by transport rollers 42 through guide path 43 into registration roll pad 28.

Figure 3A:
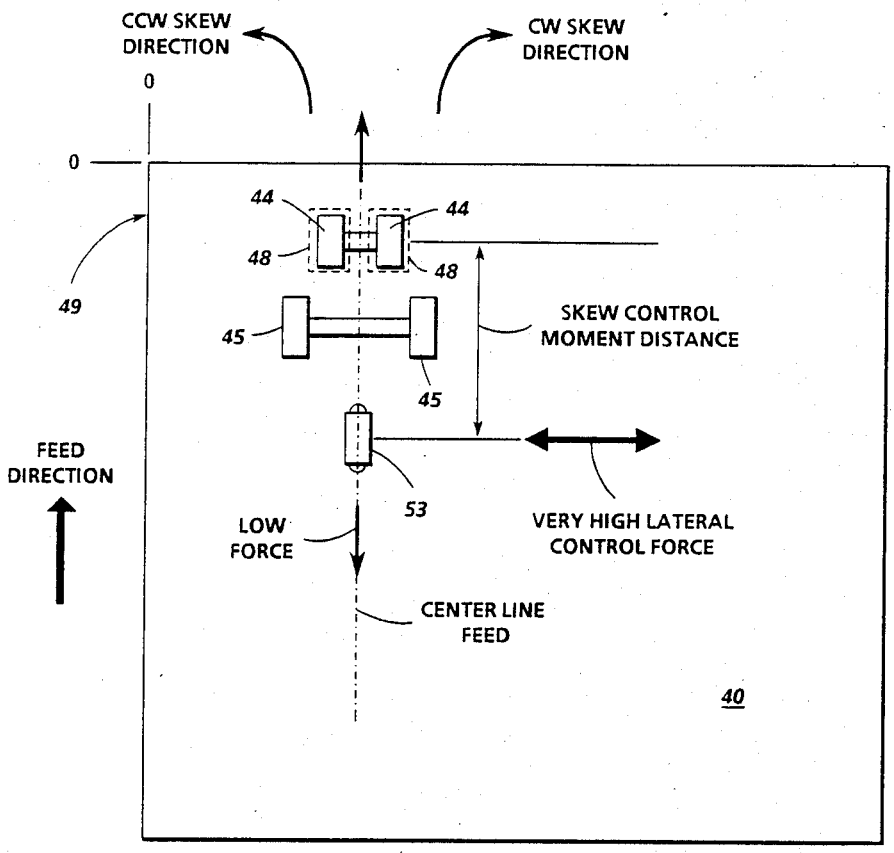
FIGS. 3A, 3B, and 3C are plan views of alternative embodiments of the present invention illustrating in FIG. 3A the location of the skew control idler roll upstream of the feed roll, in FIG. 3B the skew control idler roll downstream of the feed rolls and in FIG. 3C in both upstream and downstream positions.

The bypass feeder 39 is used in those situations where a small number of prints are desired on copy sheets which are not present in any of the normal paper trays. The bypass feeder comprises a feeding surface over which the sheets may be fed which may comprise a planar feed table 40 with an entry chute 41. Retard pads 48 are positioned in the feed table to form a retard separation feeding nip between feed rolls 44. The retard pads are typically made of polyurethane or silicone rubber and may be spring biased upwardly into contact with the feed rolls to provide a suitable normal force. As completely illustrated in FIG. 4, the feed rolls 44 are fixedly mounted on feed roll shaft 46 which is mounted on frame supports 51 with one end of the shaft 46 being driven by worm gear connections 60 and 61 by motor 62. A pair of brackets 52 are journalled on feed roll shaft 46 and support at the free end a nudger roll shaft 47 having two nudger rolls 45 spaced apart. The nudger roll shaft and accordingly the nudger rolls are driven by O-Ring drive belt 50 from feed roll drive shaft 46 through drive hubs 54 and 59. The nudger rolls, in operation, are on top of a stack of sheets and when driven tend to shingle the sheets in the stack and feed the top sheet to the feed roll retard pad nip. As illustrated in FIGS. 2 and 3A, a skew control idler roll according to the present invention is positioned upstream of the feed roll and nudger roll mechanism. The skew control idler roll 53 comprises a mounting frame 58 with two spring steel legs 51, one on each side of the idler roll, which apply a normal force to the feed table 40 and which enables the idler roll to move vertically in response to the thickness of the stack of sheets under it. The idler roll 53 has a core 55 with a high frictional surface 57 for contact with the sheets to be fed. When the bypass feeder 39 is used the regular segmented feed roll 27 is deactivated and the feed rolls 44 feed the sheet all the way to registration rolls 28.

As clearly illustrated in FIG. 3A, the two feed rolls 44 and the two nudger rolls 45 are arranged such that they are on the same centerline in the feeding direction, with the centerline being midway between each of the pairs of rolls. In addition as illustrated, the skew control idler roll 53 is also on the centerline so that there is no torque imparted to drive the sheet in either a clockwise direction or a counterclockwise direction. Furthermore, the skew control idler roll provides a very low normal force to the stack of sheets so that there is a very low retarding force in the feeding direction. Typically, the normal force applied by the skew control idler roll to the sheet being fed is from about 30 to about 70 grams. In addition, the skew control idler roll has high frictional surface having a coefficient of friction with the sheet being fed such as paper of from about 1.5 to about 1.75. As a result of this high frictional surface, there is also a high lateral control force that prevents the sheet on which the skew control idler roll is acting from wandering. In other words, the skew control idler roll permits with great ease movement in the feeding direction but inhibits with a high control force any attempt to move in a lateral direction or direction other than the feeding direction. Accordingly, if a stack of sheets is inserted so that the stack is reasonably well registered against the registration edge 49 the effect of the skew control idler roll will be to permit the sheet to be fed in a forward direction while inhibiting any skew in either direction. As discussed previously, this is of importance particularly with regard to sheet feeders wherein the centerline of the feeding mechanism may not correspond to the centerline of the sheet being fed. Thus, for example, as illustrated in FIG. 3A, if the centerline of the feeding mechanism is closer to the registration edge than the other edge of the paper there will be tendency to be a clockwise skew. Conversely, if the centerline of the feeding head is further from the registration edge than the opposite side of the stack of sheets there will tendency be skew in the counterclockwise direction. With such a light normal force upon the paper as the feed roll feeds the sheet forward the skew control idler roll is turned by the sheet being pulled by the feed rolls from under it. As a result of this geometry and the high friction surface of the skew control idler roll, a control or resisting torque is generated which is the product of the distance form the feed rolls to the skew control idler roll times the lateral force necessary to be overcome which is the product of the normal force and the coefficient of friction. As illustrated more completely in FIG. 6, the skew control idler roll may comprise a neoprene O-ring frictional contact surface 57 on a plastic Delrin, for example, hub 55 supported on a stainless steel shaft 56.

By the term centerline of feed it is intended to define those feeding systems wherein the mechanism of feeding acts on a sheet in such a way that the feeding forces are in a direction either on a line or are symmetrical about a line parallel to the feeding direction. Typically, this will involve a feeding mechanism wherein there is a registration edge for the stack of sheets to align originally also parallel to the feeding direction. This may be more clearly illustrated with reference to FIG. 3A wherein two feed rolls are axially spaced on an axis perpendicular to the feeding direction but rotatable in the feeding direction and form a separating feeding nip with the retard pads and the centerline of the feed rolls is midway between the two feed rolls. Furthermore, the nudger rolls are also rotatable in the feeding direction and axially spaced on an axis perpendicular to the feeding direction and the centerline of feed is midway between the nudger roll. The nudger rolls are positioned upstream of the nip formed between the feed rolls and the retard pads so that upon rotation, they tend to urge a sheet being fed into the nip since in operation, the stack of sheets would be manually inserted under both the skew control idler roll and the nudger roll and parallel to the registration edge 49.

Figure 3B:
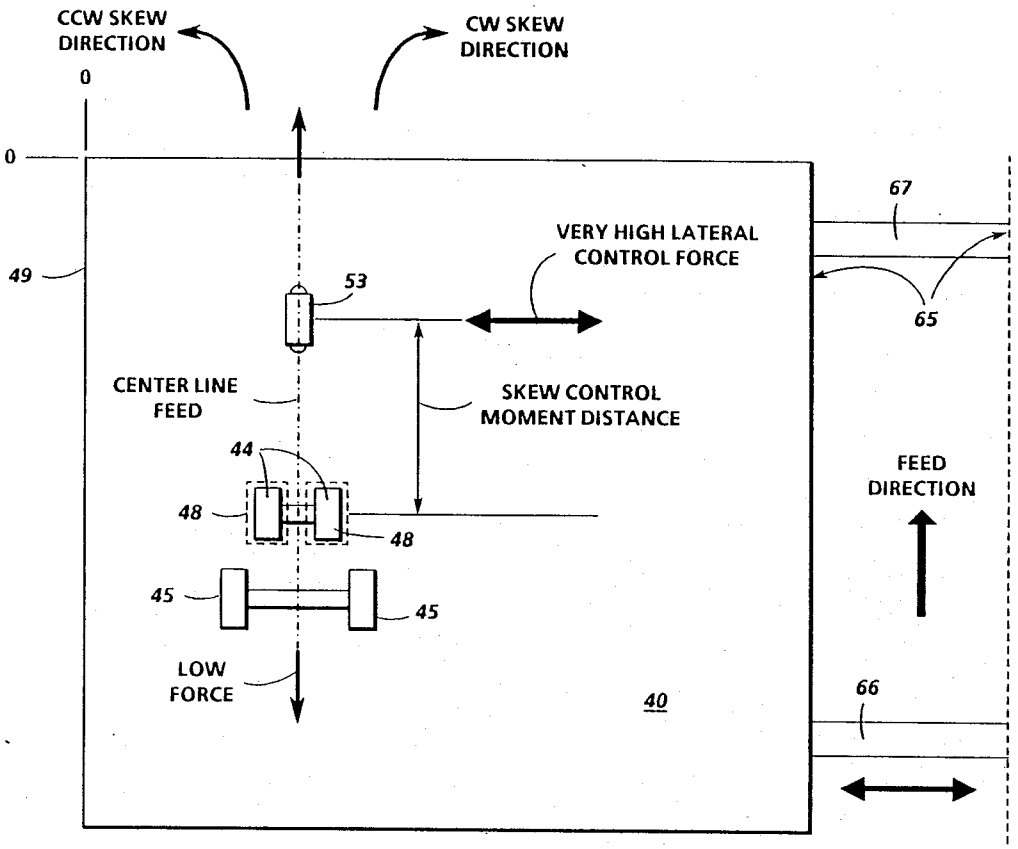
Figure 3C:
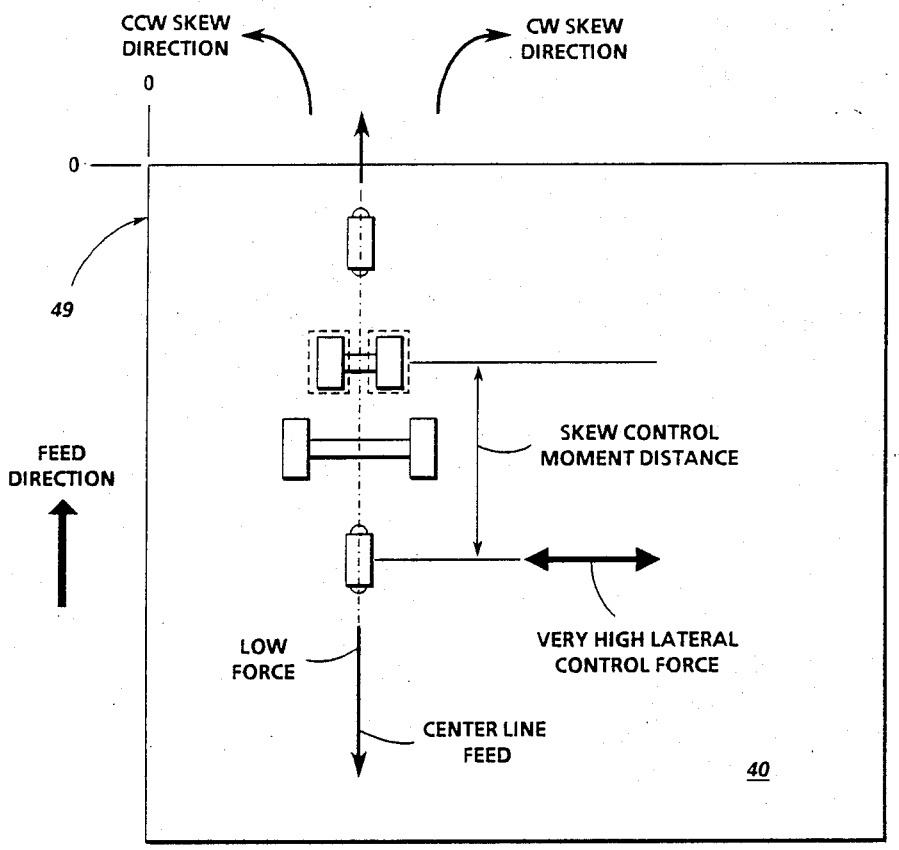

Attention is now directed to FIGS. 3B and 3C wherein alternative embodiments of the present invention are illustrated. In FIG. 3B, a registration edge 65 is movably mounted laterally in the direction of the bidirectional arrow on rails 66, 67 on guide pins (not shown) under the feed table to accommodate the feeding of sheets of different dimensions. In addition, a skew control idler roll 53 has been inserted in the feed path downstream of the feed rolls 44. Accordingly, the feed rolls in this embodiment would push the sheet being fed into the nip formed between the feed table and the skew control idler roll creating the same inhibition in the sheet being fed to prevent it from walking or skewing in either direction. For maximum affect of the skew control idler roll in either embodiment described with reference to FIGS. 3A and 3B the distance in the feeding direction between feeding means the idler roll is less than the dimension in the feeding direction of a sheet to be fed. The embodiment illustrated in FIG. 3C is the ultimate alternative embodiment wherein skew control idler rolls are positioned both upstream and downstream of the feeding mechanism.

Figure 4:
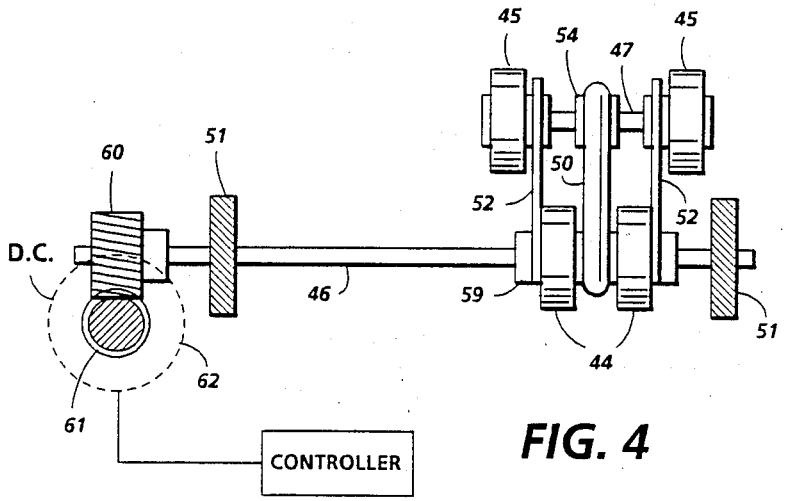
FIG. 4 is a top view of the feed roll, nudger roll assembly together with its drive mechanism.
Figure 5A:
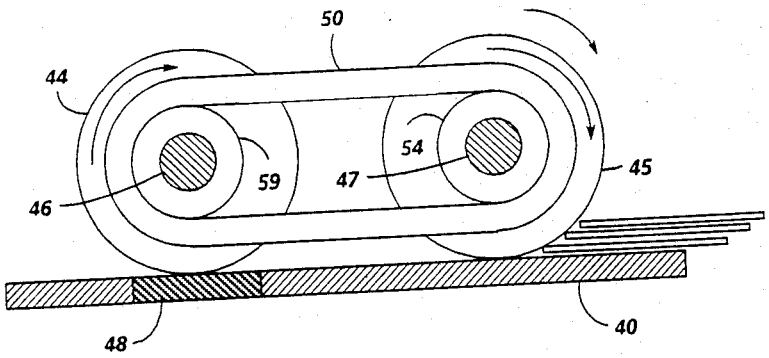
FIGS. 5A and 5B are sectional views of the feed roll and nudger roll illustrating the effect of reversing the drive direction.
Figure 5B:
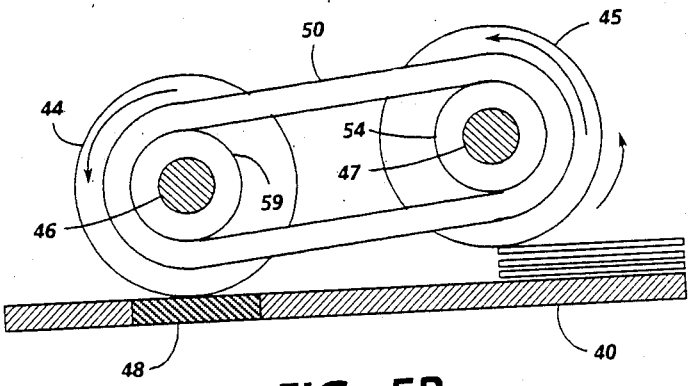

With continued reference to FIG. 4, 5A and 5B the invention will be described in greater detail. As illustrated in FIG. 5A, when a supply of sheets has been depleted such as at the end of a sheet feeding job or clearance of paper following a paper jam, the nudger roll is in contact with the feed table making it difficult to insert a fresh supply of sheets between the nudger roll and the feed table particularly if rotational movement of the feed roll and the nudger roll in the feeding direction is actuated. To alleviate this condition and as illustrated in FIG. 5B, following completion of certain identified feeding conditions such as the completion of a printing run, depletion of the sheet supply or clearance of a sheet jam the control logic of the apparatus actuates a relay and reverses the direction of the direct current applied to the d.c. motor thereby reversing motor direction. This reverses the direction of the feed roll which through the O-ring drive reverses the direction of the nudger roll. The feed roll shaft drives the O-ring by friction through hub 59 and the O-ring in turn drives the nudger roll by friction through hub 54. The drive torque on the nudger roll tends to urge the nudger roll upwardly away from the feed table. Typically to ensure this frictional drive of the nudger roll by the O-ring the coefficient of friction between the O-ring and feed roll hub and nudger roll hub is from about 1.5 to about 1.8. Typically, the gap achieved between the bottom of the nudger roll and the feed table is greater than about four millimeters to enable the insertion of a small stack of the sheet, for example up to about 20. This may be achieved by reversing the direction of rotation for a very short period of time of the order of less than 200 milliseconds and the nudger roll will remain in the raised position due to friction between it and the O-ring drive until the feeding apparatus has once again actuated to feed sheets. This gap between the bottom of the nudger roll and the feed table will enable the manual insertion of a stack of sheets in preparation for the next sheet feeding operation as illustrated in FIG. 5B. Both the feed rolls and the nudger rolls may be made from suitable materials to provide the desired sheet feeding relationship. In addition, the drive hubs on the feed roll shaft and nudger roll shaft are made from materials which provide the necessary frictional driving relationship between the O-ring and the feed roll hub and the nudger roll hub. Typically, they can be made from an elastomeric material such as isoprene.

Thus according to the present invention, a very effective, low cost means to inhibit skew or rather control skew has been provided. It provides a unidirectional control of paper feeding skew with minimum variation in skew and centration. As a result it is very effective in reducing if not eliminating paper skew, sheet buckling and eventually sheet jamming. The invention has application in not just a side registration feeding system but rather has application with regard to center registration feeding mechanisms. Furthermore, it is not limited to application with friction retard feeding devices nor with top or bottom feeding devices. It should also be noted that it is not limited to the feeding of copy sheets but has equal application to the feeding of documents. Furthermore, since the skew control idler roll was on the centerline of the feed rolls, there is no torque imparted to drive the sheet in a clockwise or counterclockwise direction over which some eventual control must be manifested. In addition, in contrast to the prior art techniques wherein a torque couple is applied to the paper or to the sheet to rotate the sheet against an edge guide, the skew control idler roll of the present invention is a passive device having a very low retarding force on the feeding of paper in a direction along the centerline of feed but also having a high lateral control force that prevents the sheet from wandering or skewing.

The disclosures of the publications referred to herein is hereby specifically and totally incorporated herein by reference.

While the invention has been described with reference to specific embodiments, it will be apparent to those skilled in the art that many alternatives, modifications and variations may be made as for example discussed above. Accordingly, it is intended to embrace all such alternatives, modifications as may fall within the spirit and scope of the appended claims.

We claim:

1. Apparatus for feeding sheets comprising a surface over which a sheet may be fed, means for feeding sheets over said surface, said feeding means having a centerline of feed parallel to the direction of sheet feeding and at least one means to inhibit skewing of a sheet being fed by said feed means over said surface comprising an idler roll mounted for rotational contact with a sheet being fed on the centerline of the feed means whereby a torque is not imparted to a sheet being fed in either the clockwise or counterclockwise direction when the feed means imparts no torque to a sheet being fed, said idler roll having a high frictional contact surface and being mounted to provide a low drag force in the feeding direction and a high lateral drag force to inhibit a sheet being fed from skewing.

2. The sheet feeding apparatus of claim 1 wherein said means to inhibit skewing is upstream of said feeding means.

3. The sheet feeding apparatus of claim 1 wherein said means to inhibit skewing is downstream of said feeding means.

4. The sheet feeding apparatus of claim 2 further including a second means to inhibit skewing downstream of said feeding means.

5. The sheet feeding apparatus of claim 1 wherein said surface over which a sheet may be fed is a planar feed table with a side edge guide parallel to the feeding direction at one end of said feed table to guide a sheet being fed.

6. The sheet feeding apparatus of claim 5 wherein said side edge guide is positioned a fixed lateral distance from the centerline of feed to provide a side registration of sheets being fed.

7. The sheet feeding apparatus of claim 5 wherein said side edge guide is movable relative to said feed table and said feeding means is fixed relative to said feed table.

8. The sheet feeding apparatus of claim 1 wherein the distance in the feeding direction between the feeding means and the idler roll is less than the dimension in the feeding direction of a sheet to be fed.

9. The sheet feeding apparatus of claim 1 wherein the idler roll has a coefficient of friction with the sheet being fed of from about 1.5 to about 1.75.

10. The sheet feeding apparatus of claim 1 wherein the idler roll provides a normal force on a sheet being fed of from about 30 grams to about 70 grams.

11. The sheet feeding apparatus of claim 1 wherein the feeding means is a top feeding friction retard feeder comprising a retard pad on the surface over which a sheet may be fed and two feed rolls rotatable in the feeding direction and forming a separating feeding nip with said retard pad, said rolls being axially spaced on an axis perpendicular to the feeding direction, and wherein the centerline of feed is midway between the feed rolls.

12. The sheet feeding apparatus of claim 11 further including two nudger rolls rotatable in the feeding direction and axially spaced on an axis perpendicular to the feeding direction and wherein the centerline of feed is midway between the nudger rolls, said nudger rolls being positioned upstream of said nip between the feed rolls and the retard pad and which on rotation urge a sheet being fed into said nip.

13. The sheet feeding apparatus of claim 12 wherein said means to inhibit skewing is upstream of said feeding means.

14. The sheet feeding apparatus of claim 12 wherein said means to inhibit skewing is downstream of said feeding means.

15. The sheet feeding apparatus of claim 14 further including a second means to inhibit skewing downstream of said feeding means.

16. The sheet feeding apparatus of claim 12 wherein said surface over which a sheet may be fed is a planar feed table with a side edge guide parallel to the feeding direction at one end of said feed table to guide a sheet being fed.

17. The sheet feeding apparatus of claim 16 wherein said side edge guide is positioned a fixed lateral distance from the centerline of feed to provide a side registration of sheets being fed.

18. The sheet feeding apparatus of claim 12 wherein the distance in the feeding direction between the feeding means and the idler roll is less than the dimension in the feeding direction of a sheet to be fed.

19. The sheet feeding apparatus of claim 12 wherein the idler roll has a coefficient of friction with the sheet being of from about 1.5 to about 1.75.

20. The sheet feeding apparatus of claim 12 wherein the idler roll provides a normal force on a sheet being fed of from about 30 grams to about 70 grams.

* * * * *